United States Patent [19]

Niekrasz

[11] 4,416,086

[45] Nov. 22, 1983

[54] ADJUSTABLE DOOR MOUNTING ARRANGEMENT FOR REFRIGERATED DISPLAY CABINETS

[75] Inventor: Frank M. Niekrasz, Homewood, Ill.

[73] Assignee: Ardco, Inc., Chicago, Ill.

[21] Appl. No.: 289,779

[22] Filed: Aug. 3, 1981

[51] Int. Cl.[3] ..... E05D 7/08

[52] U.S. Cl. ..... 49/388; 49/501

[58] Field of Search ..... 49/501, 388, 70, 382, 49/400, 386; 160/206

[56] References Cited

U.S. PATENT DOCUMENTS

| | | | |
|---|---|---|---|
| 3,254,452 | 6/1966 | Constantini et al. | 49/386 |
| 3,302,691 | 2/1967 | Andrews et al. | 160/206 |
| 3,331,159 | 7/1967 | Cooke et al. | 49/386 X |
| 3,396,490 | 8/1968 | Dakas | 49/382 |
| 3,629,972 | 12/1971 | Rehberg et al. | 49/386 X |
| 4,223,482 | 9/1980 | Barroero et al. | 493/386 |

*Primary Examiner*—Kenneth Downey

*Attorney, Agent, or Firm*—Dressler, Goldsmith, Shore, Sutker & Milnamow, Ltd.

[57] ABSTRACT

An improved adjustable mounting arrangement for mounting a glass door assembly on a door frame for a refrigerated display cabinet. The mounting arrangement includes upper and lower hinge assemblies for providing swinging movement of the door assembly relative to the door frame, with the hinge assembly accommodating adjustment of the hinge axis relative to the door frame for alignment of the door assembly in order to provide effective sealing and enhanced appearance of the display case. The hinge assemblies include upper and lower hinge brackets which are adapted to receive upper and lower hinge pins of the door assembly, the brackets being adapted to be attached to frame members of the door frame in different positions for effecting alignment of the door.

19 Claims, 5 Drawing Figures

FIG. 1
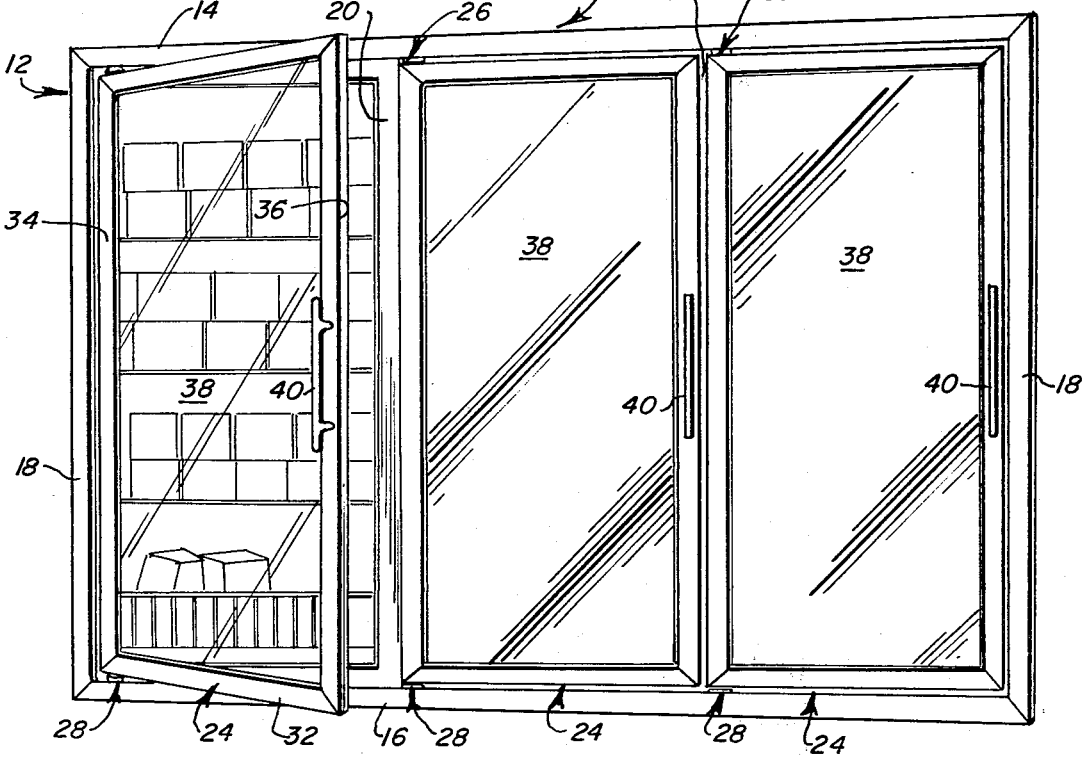
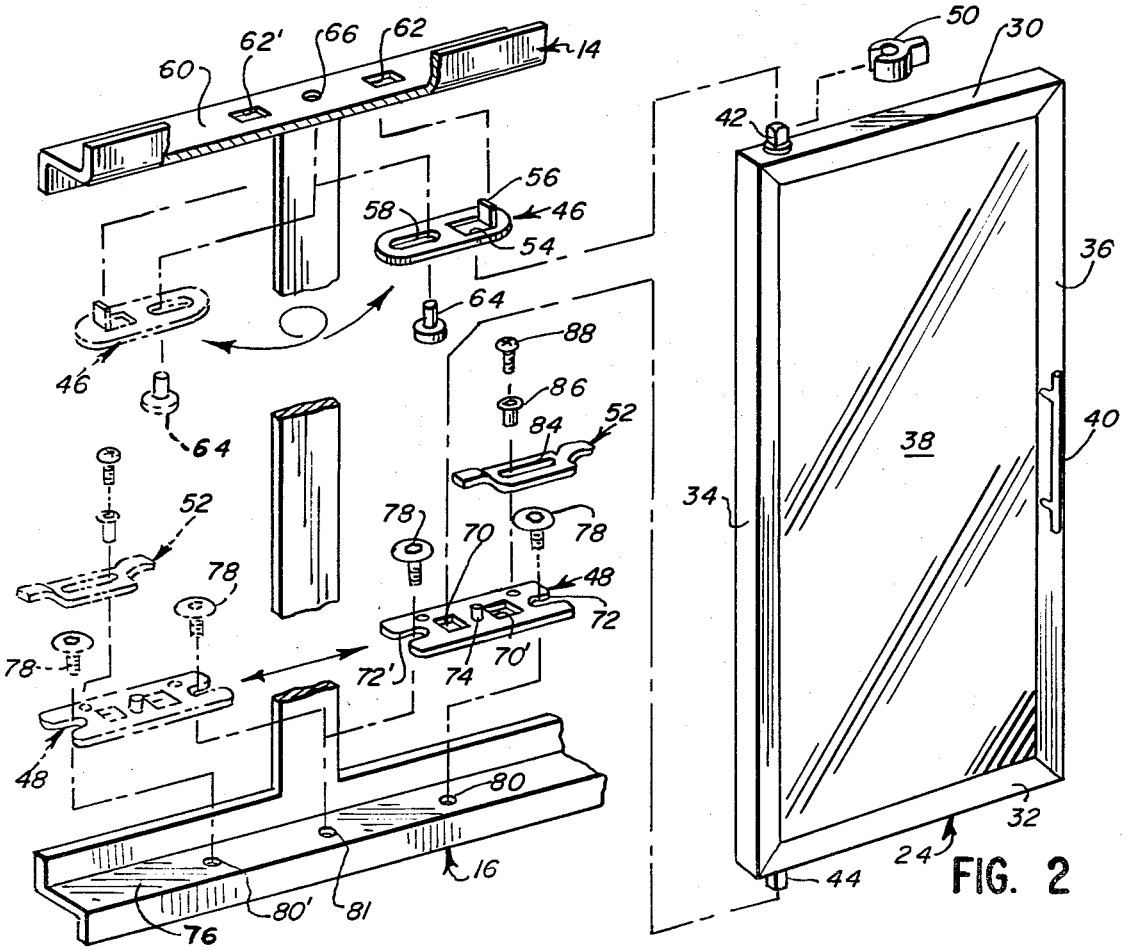
FIG. 2

FIG. 3
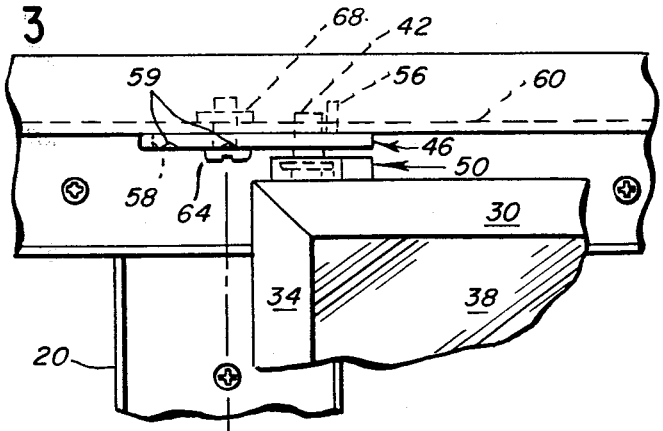
FIG. 4
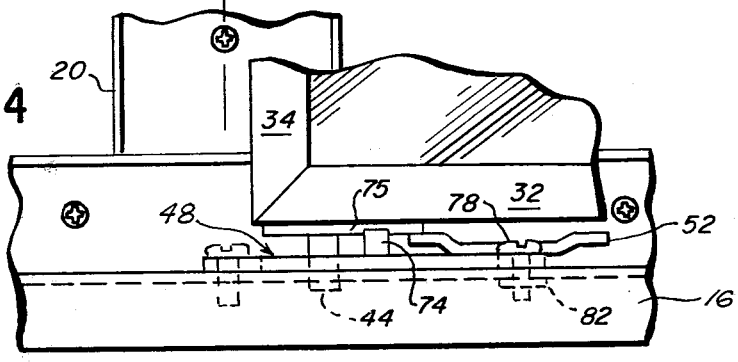
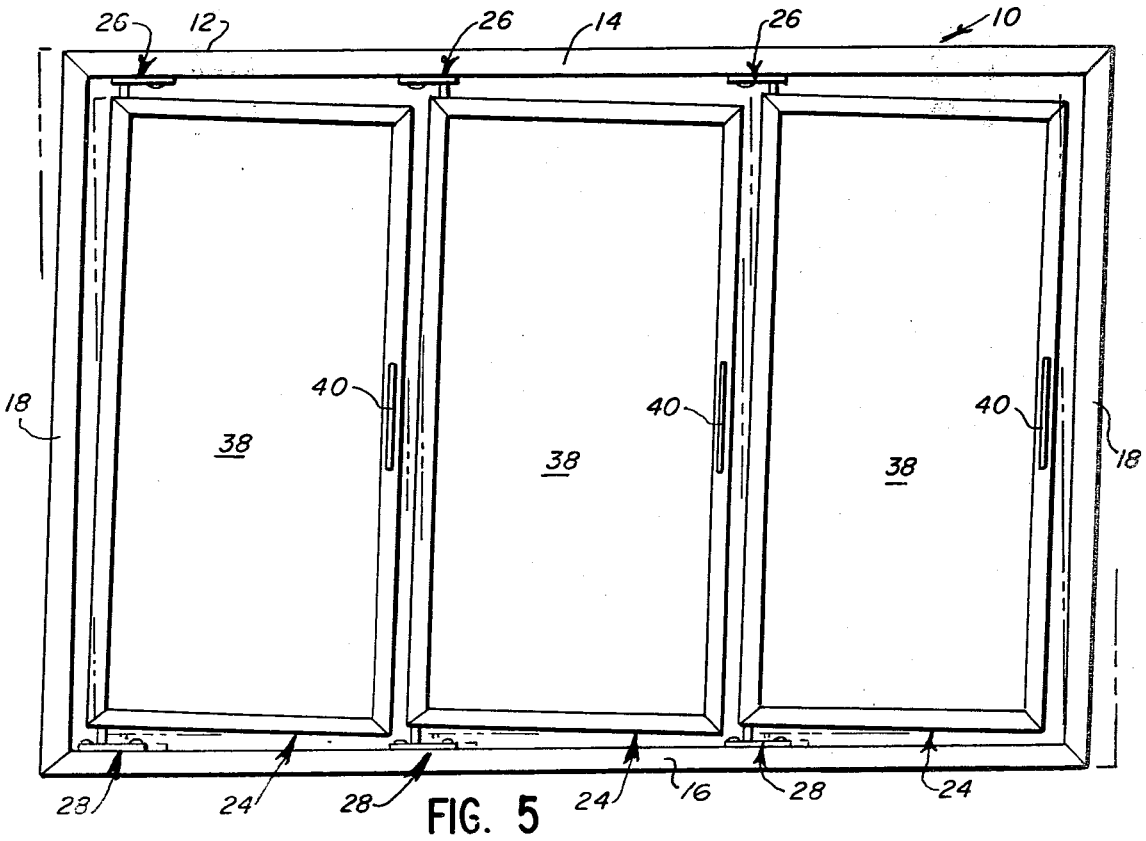
FIG. 5

ADJUSTABLE DOOR MOUNTING ARRANGEMENT FOR REFRIGERATED DISPLAY CABINETS

TECHNICAL FIELD

The present invention relate generally to commercial refrigerator door assemblies and more particularly to an adjustable door mounting arrangement for such door assemblies.

BACKGROUND OF THE INVENTION

There exists a wide variety of commercial refrigerator door assemblies. One very common type utilizes glass panel refrigerator doors, such as are illustrated in the Kurowski U.S. Pat. Nos. 2,987,782, and 3,131,421. Such refrigerator door assemblies are widely used in a variety of commercial installations of refrigerated display cases and cabinets from which purchasers may select refrigerated beverages, foods, and other products.

Commercial refrigerator door assemblies are often of the type in which glass panels are mounted in a metal supporting door frame. One or more door assemblies are generally mounted in a metal outer frame or casing, and are frequently arranged side-by-side. Each door assembly is provided with suitable sealing gaskets in order to effect efficient sealing of the display cabinet when the doors are closed.

Installation of refrigerated cabinet door assemblies of the above type is usually effected by installing a relatively large rectangular metal frame about the front of the display cabinet. The frame may include one or more vertically extending and laterally spaced vertical columns or mullions for providing the proper support and sealing surfaces for the door assemblies. After this outer frame has been put in place within the opening of the refrigerated cabinet, it must be carefully aligned so that it forms a true rectangle as nearly as possible. Clamps, wedges, and other devices may be used to align and straighten the frame before it is fixed to the cabinet opening by suitable mechanical fasteners.

Unfortunately, the installation of the frame in the above-described manner is not always performed correctly. As a result, the corners of the frame are not disposed at right angles, and the frame does not define the desired rectangular configuration. This is undesirable for several reasons. Because the frame supports each of the door assemblies for hinging movement with respect thereto, the alignment of the doors is dependent upon correct alignment of the cabinet or outer frame.

If the outer frame is misaligned, each of the doors within the frame will also be misaligned with respect thereto. As a result, all of the doors will appear to sag, and the entire face of the cabinet, with each of the doors "leaning" or "sagging" has what is referred to as a "saw-toothed" appearance. Door assemblies may also become misaligned as the result of normal wear after repeated opening and closing.

This condition is unsightly, and may adversely affect the ease of opening and closing the doors of the cabinet. More importantly, this condition may adversely affect effective sealing between the cabinet and the gaskets provided on each of the door assemblies. This obviously is very undesirable. The refrigeration unit of the refrigerated cabinet is made to work harder to the detriment of energy efficiency and maintenance, and the goods stored within the cabinet may no longer be maintained at sufficiently low temperatures to assure freshness and lack of spoilage. Thus, it is important that this condition be corrected, for the sake of both attractive appearance as well as efficient storage of refrigerated goods.

Heretofore, the correction of misaligned frames and door assemblies has been time consuming and labor intensive. It was necessary for the outer frame to be realigned. This frequently necessitated shutting off the refrigeration unit, removing the contents from the cabinet for storage elsewhere under refrigeration, and removal of the door assemblies in order to properly align the door frame. Without such corrective action, the above-described problems would continue to exist, to the detriment of efficient refrigerated storage and convenient consumer use.

Thus, the introduction of a simple, easy to install, and readily adjusted door mounting arrangement would be desirable both for new refrigerated cabinet door assemblies, as well as for retrofitting to existing refrigerated cabinet door assemblies.

SUMMARY OF THE INVENTION

In accordance with the present invention, there is provided a simple hinge mounting arrangement for the door assemblies for commercial refrigerated display cabinets which facilitates ready adjustment and alignment of the door assemblies within the cabinet frame. The hinge mounting arrangement of the present invention is adaptable for use with reversible door assemblies, i.e., installations in which the doors may be hinged to open along either their right or left side edges. Because many of the refrigerated door assemblies presently in use are such reversible types, adaptability of the hinge mounting arrangement of the subject invention greatly increases its versatility and provides an alignment correcting arrangement which is suitable for a great many door installations.

Door assemblies of the type to which the subject invention pertains typically include a rectangular door frame of extruded metal within which is supported two or more spaced apart glass panels. The glass panels are spaced such that there is a thin layer of "dead" air disposed between them which provides good insulating properties. One or more of the glass panels and the door frame may be electrically heated to preclude formation of condensation thereon. Each of the door assemblies is mounted to the cabinet frame by hinge assemblies which include upper and lower hinge pins which are disposed at respective upper and lower corners of the doors. These pins are typically of a square or rectangular cross-section, and each door is pivoted with respect thereto for providing hinging action between the door and the cabinet frame. The hinge assemblies usually incorporate a spring loading mechanism such that the door tends to close itself after it is opened to and sealingly engage surfaces of the frame.

Hinge assemblies in accordance with the present invention include upper and lower hinge brackets provided for mounting the door within the frame, and for adjusting the rotational axis of the door. The lower hinge bracket comprises a generally elongated flat plate which includes an aperture adapted to receive the lower hinge pin of the door and to prevent the rotation of same with respect to the cabinet frame. The lower hinge bracket is also provided with suitable slots to receive mechanical fasteners for adjustably attaching the lower hinge bracket to the bottom of the cabinet frame. The hinge bracket may typically include an upstanding projection or peg which acts as a door stop for preventing excessive opening of the door.

The lower hinge assembly may also include a generally elongated slide stop fastened to the lower hinge bracket for sliding movement with respect thereto. When the slide stop is moved to one position with respect to the lower hinge bracket, the door assembly may be opened and closed in a normal fashion. However, if it is desired to maintain the door assembly in an open position, such as for maintenance or for stocking goods within the refrigerated cabinet, the door assembly may be opened and the slide stop manipulated by sliding it with respect to the lower hinge bracket so that the door assembly is then maintained in an opened position.

The upper hinge assembly incorporating the present invention includes an upper hinge bracket which is adapted to cooperate with the upper frame member of the frame for providing adjustable mounting of the upper hinge pin of the door assembly. The upper hinge bracket includes a cut-out or slot portion adapted to receive the upper hinge pin of the door assembly. The upper hinge bracket further includes an upstanding hinge tab or lug which is disposed adjacent to the upper hinge pin slot, and extends upwardly from the hinge bracket. The hinge bracket also defines an elongated slot which is adapted to receive a suitable mechanical fastener.

In order to provide adjustable hinge mounting of the upper hinge pin, the top of the cabinet frame includes an elongated cut-out or slot portion adapted to receive therein the upstanding hinge tab or lug of the upper hinge bracket and the upper hinge pin. The top frame member also defines a suitable hole or cut-out for receiving a mechanical fastener which fits through the slotted portion of the upper hinge bracket. Thus, in order to prepare the frame for mounting of the upper hinge pin therein, the upper hinge bracket is fitted to the top frame member, with the upstanding tab of the hinge bracket projecting into the hinge slot provided in the upper frame member. A suitable mechanical fastener is inserted through the elongated slot defined in the hinge bracket and suitably fastened to the web of the upper frame member.

Before the mechanical fastener is fully tightened, simple and effective adjustment of the upper hinge pin bracket with respect to the top frame member is possible. Because the slot in the upper frame member is elongated, the tab or lug element of the upper hinge bracket, and the upper hinge pin which project therein are shiftable or movable with respect to the slot in the upper frame member. This shifting or displacement is accommodated by the elongated slot provided in the hinge bracket through which the mechanical fastener connecting the bracket to the upper frame member extends. In order to assist installation or maintenance personnel in achieving correct alignment of the door assembly, the upper hinge pin bracket may include gauge marks or other indicia for establishing correct alignment of the upper hinge pin bracket with the upper frame member. When this is achieved, the mechanical fastener may be fully tightened so that the hinge bracket is held tightly and securely to the upper frame member.

Installation of the door assembly to the frame structure is now a simple and straightforward matter in that the door assembly is moved into position adjacent to the door opening. The door assembly is then lifted into the door opening, and the upper hinge pin of the door assembly is fitted within the upper hinge pin slots of the upper hinge pin bracket and the upper frame member, respectively. As the door assembly is lifted into the door frame, the lower hinge pin of the door assembly is able to clear the lower frame member of the door frame and the lower hinge mounting bracket, whereby the bottom of the door assembly may then be swung inwardly so that the lower hinge pin may be fitted within the hinge pin slot of the lower hinge bracket. The door assembly is then lowered slightly, and is now supported by the frame and the upper and lower hinge brackets. A hinge lock is fitted about the upper hinge pin between the top of the door assembly and the upper hinge bracket to keep the door in place. The hinge lock usually includes a resilient C-shape portion which fits about and engages a portion of the upper hinge pin and prevents the door assembly from being lifted out of the door frame. If necessary, further alignment of the door assembly is easily accomplished since the upper and lower hinge brackets may be readily adjusted without removal of the door assembly from the frame. It is now a simple matter to make any necessary electrical connections between the door assembly and the frame, and to make any final adjustments to the hinge mechanisms of the door assembly.

Should it become necessary during the service life of the door structure to adjust the alignment of one or more of the door assemblies, it is now a simple matter of loosening the mechanical fastener provided for fixing the upper hinge bracket to the upper frame member, and shifting or displacing the upper hinge bracket with respect to the upper frame member such that the door assembly is brought into alignment with respect to the door opening. Similarly, adjustment of the lower hinge bracket may be accomplished by loosening its fasteners and shifting it with respect to the lower member of the door frame. Because of the novel arrangement of the elements of the subject hinge mounting arrangement, it will usually be totally unnecessary to even remove the door assembly from the door frame when these adjustments are made, thus greatly simplifying alignment of the door assemblies for effective sealing of the refrigerated cabinet and enhanced appearance.

BRIEF DESCRIPTION OF THE DRAWINGS

FIG. 1 is a perspective view of a portion of the front of a refrigerated display cabinet including a plurality of hingedly connected door assemblies;

FIG. 2 is an exploded perspective view illustrating the components of applicant's novel adjustable hinge mounting arrangement and the assembly thereof;

FIG. 3 is a fragmentary elevational view illustrating the upper hinge mounting of one of the door assemblies illustrated in FIG. 1;

FIG. 4 is a fragmentary elevational view of the lower hinge mounting arrangement of one of the door assemblies illustrated in FIG. 1;

FIG. 5 is an elevational view of a refrigerated display cabinet as illustrated in FIG. 1 wherein misalignment of the frame has occurred and the door assemblies have assumed a misaligned saw-toothed condition.

DESCRIPTION OF THE PREFERRED EMBODIMENT

While the subject invention is susceptible to embodiment in different forms, there is shown in the drawings and will hereinafter be described a preferred embodiment with the understanding that the present disclosure is to be considered as an exemplification of the principles of the invention and is not intended to limit the invention to the embodiment illustrated.

With reference now to FIG. 1, there is illustrated the front of a refrigerated display case in which is installed a door structure 10 having a plurality of glass panel door assemblies. For purposes of illustration, the door structure 10 has been shown as including three hinged door assemblies, but it will be understood that the subject invention is adaptable for use with any number of door assemblies.

The door structure 10 includes a cabinet frame 12 which extends generally about the periphery of the front of the display cabinet. The frame 12 includes a top or upper frame member 14, a bottom or lower frame member 16, and suitably laterally spaced side frame members 18 extending therebetween. The frame members are adapted to be arranged in a rectangular configuration with the respective end portion of the frame members forming 90 degree angles in each of the corners of the frame. The frame 12 also includes one or more columns or mullions 20 which extend vertically between the lower frame member 16 and the upper frame member 14 and are connected thereto. The mullions 20 not only provide rigidification of the door frame 12 and the door structure 10, but also define sealing surfaces against which portions of the door assemblies of the door structure 10 engage and seal for effective sealing of the refrigerated cabinet. The mullions 20 may also be equipped with electrical conduits for delivering electrical power to anti-condensation devices within the door assemblies of the door structure 10.

The refrigerated door structure 10 includes the insulated glass door assemblies 24 hinged to the door frame 12 which are adapted to swing inwardly and outwardly with respect to the door frame 12 so that the inside of the refrigerated cabinet is easily accessible by purchasers, or by store personnel for stocking of the cabinet. Each of the door assemblies 24 is mounted for swinging movement by an upper hinge assembly 26 and a lower hinge assembly 28 connected to the upper frame member 14 and the lower frame member 16, respectively of the frame 12. Each of the door assemblies 24 comprises an upper door frame member 30 and a lower door frame member 32 provided respectively at the top and bottom of the door assembly 24. Each door assembly further includes an inner side frame member 34 and an outer side frame member 36 extending vertically between respective ends of the upper and lower frames 30 and 32.

Each door assembly 24 includes a plurality of glass panels 38 which are carried by the door frame members in laterally spaced relation to one another. Typically, two or more glass panels 38 are provided such that a layer of dormant or "dead" air is disposed between each adjacent panel, this construction exhibiting desirable insulation properties. Each of the door assemblies 24 is provided with a door handle 40 on its outer side frame member 36 for convenience in opening the door assembly.

With further reference to FIG. 1, and reference to FIGS. 2–4, the upper hinge assembly 26 and the lower hinge assembly 28 of each of the door assemblies 24 will now be described. Each of the door assemblies 24 is provided with an upper hinge pin 42 and a lower hinge pin 44 disposed in respective upper and lower corner portions of the door assembly 24. As shown in FIG. 2, the upper hinge pin 42 is disposed in upstanding relationship to the upper door frame member 30, while the lower hinge pin 44 projects correspondingly downwardly from the lower door frame member 32. Each of the hinge pins 42 and 44 are typically of a square or rectangular configuration in cross-section.

The door assembly 24 is pivotable with respect to the hinge pins 42 and 44, thus providing hinging movement of the door assembly 24 relative to the door frame 12. Further, one or both of the hinge pins 42 and 44 is usually associated with a spring loading mechanism carried within the door assembly 24 so that each of the door assemblies 24 is biased into sealing engagement with the sealing portions of the door frame 12, and so that each of the door assemblies 24 is self closing after it has been swung open.

The upper and lower hinge assemblies 26 and 28 further include an upper hinge bracket 46 and a lower hinge bracket 48, respectively. The upper hinge assembly 26 also includes a hinge pin lock 50 which is adapted to fit about the upper hinge pin 42 for preventing accidental removal of the door assembly 24 from the door frame 12 as will be more fully described hereinafter. The lower hinge assembly 28 may also include a hold open slide 52 which is slidably disposed with respect to the lower hinge bracket 48, and movable between a first position where the door assembly 24 may be swung inwardly and outwardly with respect to the door frame, and a second position where the door assembly 24 is maintained in open relation to the door frame 12.

With reference now to the upper hinge assembly 26 as shown in FIGS. 2 and 3, the upper hinge bracket 46 comprises a generally flat plate which defines an upper hinge pin cut-out or slot 54 therein. The hinge pin slot 54 is of a rectangular configuration, and is adapted to receive the upper hinge pin 42 therein. The hinge pin slot 54 is dimensioned such that transverse and rotation of the upper hinge pin 42 with respect to the upper hinge bracket 46 is prevented. Thus, the upper hinge pin 42 engages or abuts portions of the hinge bracket 46 defined by the hinge pin slot 54.

The upper hinge bracket 46 is further provided with an upstanding or projecting upper hinge tab or lug 56 which is disposed in upstanding relation on the bracket 46, and is adjacent to the hinge pin slot 54. The upper hinge bracket 46 also defines a generally elongated upper fastener slot 58. The upper hinge bracket 46 may also include one or more locating gauge marks 59 or other suitable indicia for assisting in alignment of the door assemblies 24 within the door frame 12 as will be described.

In order to provide a suitable mounting for the hinge assembly 26 to the upper portion of the door frame 12, the upper frame member 14 of the door frame 12 includes a generally horizontally disposed web portion 60. The web portion 60 will typically comprise an integral portion of the upper frame member 14. The web portion 60 defines upper frame member hinge slots 62 and 62' each having a generally rectangular, somewhat elongated configuration. Only one of the slots 62 and 62' will be employed at a time, both being provided for reversibility of mounting the hinge bracket 46.

Web portion 60 is adapted to receive a suitable mechanical fastener 64 within a fastener hole 66 for affixing the upper hinge bracket 46 to the upper frame member 14. Mechanical fastener 64 may be of a self-tapping variety, or may be held in position by a suitable lock nut 68 (FIG. 3).

Thus, it will be readily observed that in order to attach the upper hinge bracket 46 to the upper frame member 44, the bracket 46 is fitted against the lower surface of the web portion 60 of the upper frame member 14 such that the hinge tab or lug 56 extends upwardly into the frame member hinge pin slot 62. The bracket 46 is held in position by inserting mechanical fastener 64 through the fastener slot 58 in the bracket 46 and into fastener hole 66 defined by the web portion 60. It will be appreciated that since the hinge pin slot 62 (or 62') defined by the web portion 60 is of somewhat elongated configuration, as is the fastener slot 58 defined by the bracket 46, the bracket 46 may be easily shifted or displaced longitudinally with respect to the web portion 60 of the upper frame member 14 before the fastener 64 is fully tightened. Because the cut-out or slot 54 defined by the bracket 46 is adapted to receive the upper hinge pin 42 of the door assembly 24, the position in which the hinge pin 42 is maintained within the slot 54 is easily and readily adjustable for shifting the hinging axis of the door assembly 24 for effecting correct alignment thereof with respect to the sealing surfaces provided by the door frame 12. Locating gauge marks 59 assist in correctly aligning the bracket 46 with respect to the upper frame member 14, and after this is accomplished the mechanical fastener 64 may be fully tightened such that hinge bracket 46 is maintained in fixed relation to the upper frame member 14.

With further reference to FIG. 2 and FIG. 4, the lower hinge bracket 48 of the lower hinge assembly 28 comprises a generally flat plate which defines lower hinge pin cut-outs or slots 70 and 70'. As is the case of the cut-out or slot 54 provided in the upper hinge bracket 46, the cut-outs or slots 70 and 70' provided in the lower hinge bracket 48 are generally rectangular and are adapted to receive the lower hinge pin 44 such that longitudinal movement and rotation between the hinge pin 44 and the lower hinge bracket 48 is prevented.

Although only one of the slots 70 and 70' is used at a time for receiving the hinge pin 44, they both are provided for reversibility at the lower hinge bracket 48. The lower hinge bracket 48 further defines a pair of lower fastener slots 72 disposed at opposite ends thereof, for adjustably fastening the bracket 48 to the lower frame member 16 of the door frame 12. The hinge bracket 48 may also include an upstanding door stop projection or peg 74 which is adapted to cooperate with a suitable door stop mechanism 75 (FIG. 4) carried by the door assembly 24 for preventing excessive opening of the door assembly with respect to the door frame, which usually permits maximum opening of approximately 90 degrees of the door assembly relative to the door frame.

The lower hinge bracket 48 is suitably connected to a generally horizontally disposed lower frame web portion 76 of the lower frame member 16 by mechanical fasteners 78 which extend through the fastener slots 72 in the hinge bracket 48 into web fastener holes 80, 81 provided in the web portion 76 of the lower frame member 16. An additional fastener hole 80' is defined by the web portion 76 for accommodating reversibility of the bracket 48 as will be described. Fasteners 78 may be of the self-tapping variety, or may be provided with lock nuts 82 (FIG. 4) for adjustably attaching the lower hinge bracket 48 to the web portion 76 of the lower frame member 16.

The lower hinge assembly 28 may include the hold open slide 52 which is adapted to be slidably attached to the lower hinge bracket 48. The hold open slide 52 includes a generally elongated slide slot 84 through which a slide bushing 86 and a fastener 88 extend. The slide stop 52 is positioned on top of the lower hinge bracket 48 with the fastener 88 extending through the bushing 86 and the slide slot 84 into the bracket 48. It wll be observed that the slide stop 52 is thereby slidable with respect to the lower bracket 48 between a first position in which the door assembly 24 may be opened and closed in a normal fashion, and a second position wherein the door 24 may be maintained in open relation to the door frame 12 with the slide stop 52 preventing the closing of the door assembly.

After the frame 12 of the door structure 10 has been positioned within the opening of the display cabinet for which it is provided, the door frame is aligned so that it defines a rectangle as nearly as is practicable. The door frame 12 is then secured within the door opening, and suitably caulked and sealed. Upper and lower hinge brackets 46 and 48 are then installed on the door frame as described above, and the frame is ready to receive the door assemblies 24 for mounting therein.

Each door 24 is easily installed in its respective upper and lower hinge assemblies by lifting the door into the frame such that the upper hinge pin 42 extends into and through the hinge pin slot 54 defined by the upper hinge bracket 46 and the slot 62 defined by the web portion 60 of the upper frame member 14. The door 24 is lifted sufficiently so that the lower hinge pin 44 is able to clear the lower hinge bracket 48, and the lower portion of the door may be swung inwardly of the door frame 12 to insert hinge pin 44 in the hinge pin slot 70 defined by the lower hinge bracket 48. The entire door assembly 24 is then carefully lowered within the frame 12 to insert the lower hinge pin 44 into the hinge pin slot 70 defined by lower hinge bracket 48. After the door assembly 24 has been installed, the hinge pin lock 50 is fitted about the upper hinge pin 42 so that the door assembly 24 cannot be accidentally lifted out of the frame 12.

It will be observed that adjustment of the hinge asemblies 26 and 28 for aligning the door assembly 24 and shifting its hinging axis is now easily accomplished. The upper hinge bracket 46 may be repositioned with respect to the web portion 60 of the upper frame member 14 by partially loosening the mechanical fastener 64 extending therethrough and shifting the bracket 46 with respect to the web portion 60. Depending upon the dimensions of the upper frame member slot 62, a substantial amount of adjustment or play may be provided.

Similarly, the elongated nature of slots 72 defined by lower hinge bracket 48 permits shifting of the bracket 48 with respect to lower frame 16 by merely loosening fasteners 78, thus accommodating further adjustment of the hinge axis of the door assembly. Thus, correct alignment of the door assemblies 24 may be easily and simply accomplished.

This alignment procedure may be simply performed to compensate for sagging of the door due to normal wear and tear, for installation misalignment and for the correction of the saw-tooth condition as illustrated in FIG. 5. It will also be noted that the upper and lower hinge brackets 46 and 48 are so designed that adjustment of the bracket is possible without removal of the door assembly 24 from the door frame 12.

Adjustment of the saw-tooth condition as illustrated in FIG. 5 will be easily accomplished by swinging each of the doors 24 to an open position, loosening the respective mechanical fastener 64 and 78 of each of the hinge brackets 46 and 48, repositioning the brackets 46 and 48 to provide the correct alignment of the door assemblies 24 within the door frame 12, and tightening the mechanical fasteners 64 and 78 so that the door assemblies are simply and efficiently realigned.

As noted, the design of the components of the subject door mounting arrangement provide an extremely desirable reversability feature. Refrigerated display cabinet door assemblies of the type described herein typically may be installed for hinging movement about either a right-hand or left-hand hinge axis, e.g., by simply inverting the panels. It will be observed that the hinge mounting arrangement of the subject invention easily provides for this in that each of the upper and lower hinge brackets 46 and 48 is readily adaptable for use with right-hand or left-hand swinging doors.

As shown in FIG. 2 in phantom, the upper hinge bracket 46 needs merely to be rotated 180 degrees and fitted within hinge slot 62' of web portion 60 for providing a suitable adjustable hinge door mounting arrangement for doors which would open by swinging to the right. Similarly, the lower hinge bracket 48 may be shifted with respect to lower frame member 16 and fastened thereto by using fastener hole 81 and the additional hole 80'. The other hinge pin slot 70 is used to receive the hinge pin for doors which swing open to the right.

Upper and lower frame member 14 and 16 may be easily fabricated with both hinge slots 62 and 62', and fastener holes 80 and 80', respectively. In this way, selection of either right or left swinging movement may be made during installation depending on the specific requirements, and may be easily changed during the service life of the door structure if desired. Thus, the subject invention provides not only an adjustable door mounting arrangement for refrigerator display cabinets but is easily adaptable for door assemblies which are adapted to swing open either to the right or to the left.

From the foregoing, it will be observed that numerous variations and modifications may be effected without departing from the true spirit and scope of the novel concept of the subject invention. It will be understood that no limitations with respect to the specific apparatus illustrated herein is intended or should be inferred. It is, of course, intended to cover by the appended claims all such modifications as fall within the scope of the claims.

What is claimed is:

1. An adjustable door mounting arrangement for mounting a door on a structure comprising:

a generally rectangular frame adapted to be affixed to said structure and defining a door opening and including a first frame member and a second frame member maintained in spaced, generally parallel relation by a plurality of transversely spaced apart column members;

first and second hinge means disposed at respective upper and lower corner portions of said door for hingedly connecting said door to said frame for providing swinging movement of said door inwardly and outwardly with respect to said door opening about an axis;

said first hinge means including adjustment means for adjustably positioning the first hinge means longitudinally of said first frame member whereby the axis about which said door swings may be shifted thereby accommodating realignment of said door relative to said frame said first hinge means including a first hinge pin defining said swinging axis and extending outwardly from said door, said adjustment means comprising a first hinge bracket including a body portion defining pin receiving means and having upstanding lug means, said first frame member including a web portion defining a first slot within which said lug means extends and is selectively positionable therewithin by shifting said hinge bracket longitudinally of said first frame member, said first hinge pin extending within said pin receiving means and said first slot in said first frame member.

2. The adjustable door mounting arrangement of claim 1, wherein:

said lug means is disposed adjacent to said pin receiving means.

3. The adjustable door mounting arrangement of claim 1, wherein:

said body portion of said first hinge bracket defines elongated slot means adapted to receive a mechanical fastener for adjustably attaching said first hinge bracket to said first frame member.

4. The adjustable door mounting arrangement of claim 1, wherein:

said web portion of said first frame member defines a second slot spaced from said first slot and adapted to receive said lug, said lug being selectively positionable therewithin by shifting said bracket means longitudinally of said first frame member for accommodating opposite swinging movement of said door with respect to said frame.

5. The adjustable door mounting arrangement of claim 1, including:

hinge pin lock means adapted to engage said first hinge pin for limiting motion of said door along said axis relative to said frame.

6. The adjustable door mounting arrangement of claim 1, wherein:

said second hinge means comprises a second hinge pin defining said swinging axis, and a second hinge bracket defining a slot for receiving said second hinge pin; and said second hinge means further comprises fastener means for adjustably attaching said second bracket to said second frame member to accommodate realignment of said door relative to said frame.

7. The adjustable door mounting arrangement of claim 1, wherein:

said second hinge bracket includes upstanding stop means which cooperate with said door for limiting the outward swinging movement thereof relative to said frame.

8. An improved door structure for refrigerated display cabinets comprising:

a generally rectangular frame including upper and lower frame members and a plurality of laterally spaced column members extending therebetween defining at least one door opening;

a generally rectangular door;

upper and lower hinge assemblies for hingedly mounting said door on said frame for swinging movement about a generally vertical axis inwardly and outwardly with respect to said door opening;

said upper hinge assembly including an upper hinge pin extending upwardly from said door and upper bracket means within which said upper hinge pin is disposed; and said upper bracket means including lug means extending into said upper frame member and adjustment means for adjustable attachment of said bracket means to said upper frame member in a plurality of positions whereby the vertical swinging axis of said door may be shifted, said upper frame member including a web portion defining a slot within which said lug means and said upper hinge pin extend.

9. The door structure as recited in claim 1, wherein:

said upper bracket means defines a hinge pin slot within which said upper hinge pin is disposed, said hinge pin slot being disposed adjacent to said lug means and adapted to prevent relative rotation of said hinge pin relative to said bracket means;

said adjustment means comprises an elongated fastener slot defined by said bracket means through which an upper mechanical fastener extends for adjustably attaching said bracket means to said upper frame member.

10. The door structure as recited in claim 9, wherein:

said upper bracket means are reversibly attachable to said upper frame member, and said lower hinge bracket defines a pair of slots, said lower hinge pin being positionable in one of said slots, whereby said door is hingedly mountable on said frame by said upper and lower hinge assemblies for opposite swinging movement with respect to said door opening.

11. The door structure as recited in claim 9, wherein:

said lower hinge assembly includes a lower hinge pin extending downwardly from said door assembly and a lower hinge bracket within which said lower hinge pin is disposed;

said lower hinge bracket being adjustably attached to said lower frame member by lower mechanical fastener means.

12. The door structure as recited in claim 11, wherein:

h said lower hinge bracket includes stop means cooperative with said door for limiting outward swinging movement of said door with respect to said door opening.

13. The door structure as recited in claim 11, wherein:

said upper mechanical fastener and said lower mechanical fastener means being respctively disposed such that they are accessible when said door is mounted within said upper and lower hinge assemblies.

14. An improved door structure for refrigerated display cabinets comprising:

a generally rectangular frame including upper and lower frame members and a plurality of laterally spaced column members extending therebetween defining at least one door opening;

a generally recangular door;

upper and lower hinge assemblies for hingedly mounting said door on said frame for swinging movement about a generally vertical axis inwardly and outwardly with respect to said door opening;

said upper hinge assembly including first adjustment means for shifting the swinging axis of said door with respect to said frame;

said lower hinge assembly including second adjustment means for shifting the swinging axis of said door with respect to said frame;

whereby said first and second adjustment means accommodate realignment of said door assembly with respect to said door frame; and means for reversibly hingedly mounting said door on said frame for accommodating opposite swinging movement of said door with respect to said door opening including means for repositioning said first and second adjustment means on said frame.

15. The door structure as recited in claim 14, wherein:

said first adjustment means comprises an upper bracket defining an upper pin slot adapted to receive an upper hinge pin projecting upwardly from said door assembly, said upper bracket including an upstanding lug portion and means for adjustably attaching the upper bracket to said upper frame member; and said upper frame member includes a web portion defining a first lug slot adapted to receive said lug portion when said upper bracket is attached to said upper frame member.

16. The door structure as recited in claim 15, wherein:

said second adjustment means comprises a lower bracket defining a first lower hinge slot adapted to receive a lower hinge pin projecting downwardly from said door and further defining means for adjustably attaching the lower bracket to said lower frame member.

17. The door structure as recited in claim 16, wherein:

said means for reversibly mounting said door comprise a second lower hinge slot defined by said lower bracket and adapted to receive said lower hinge pin, and a second lug slot defined by said web portion and adapted to receive said lug portion when said upper bracket is reversibly attached to said upper frame member.

18. An adjustable door mounting arrangement for mounting a door on a structure comprising:

a generally rectangular frame adapted to be affixed to said structure and defining a door opening and including a first frame member and a second frame member maintained in spaced, generally parallel relation by a plurality of transversely spaced apart column members;

first and second hinge means disposed at respective upper and lower corner portions of said door for hingedly connecting said door to said frame for providing swinging movement of said door inwardly and outwardly with respect to said door opening about an axis;

said first hinge means including adjustment means for adjustably positioning the first hinge means longitudinally of said first frame member whereby the axis about which said door swings may be shifted thereby accommodating realignment of said door relative to said frame;

said first hinge means including a first hinge pin defining said swinging axis and extending from a corner portion of said door;

said adjustment means comprising a first bracket defining slot means for receiving said hinge pin, said first bracket further defining adjustable fastener means for receiving a fastener for adjustable attachment of said bracket to said first frame member;

said second hinge means comprising a second hinge pin defining said swinging axis, and a second hinge bracket defining a slot for receiving said second hinge pin, said second hinge means further comprising fastener means for adjustably attaching said second bracket to said second frame member to accommodate realignment of said door relative to said frame;

said second hinge means including hold-open means movable between a first position wherein said door is swingingly movable with respect to said frame in a second position wherein said door is maintained in a selected position relative to said frame.

19. An adjustable door mounting arrangement for mounting a door on a structure comprising:

a generally rectangular frame adapted to be affixed to said structure and defining a door opening and including a first frame member and a second frame member maintained in spaced, generally parallel relation by a plurality of transversely spaced apart column members;

first and second hinge means disposed at respective upper and lower corner portions of said door for hingedly connecting said door to said frame for providing swinging movement of said door inwardly and outwardly with respect to said door opening about an axis;

said hinge means including adjustment means for adjustably positioning the first hinge means longitudinally of said first frame member whereby the axis about which said door swings may be shifted thereby accommodating realignment of said door relative to said frame;

said first hinge means including a first hinge pin defining said swinging axis and extending outwardly from said door;

said adjustment means comprising first bracket means including a body portion defining pin receiving means and having an upstanding lug adjacent said pin receiving means;

said first frame member including a web portion defining a first slot within which said lug extends and is selectively positionable therewithin by shifting said bracket means longitudinally of said first frame member, said first hinge pin extending within said pin receiving means and said first slot;

said second hinge means comprising a second hinge pin defining said swinging axis, and a second hinge bracket defining a slot for receiving said second hinge pin;

said second hinge means including hold-open means movable between a first position wherein said door is swingingly movable with respect to said frame and a second position wherein said door is maintained in a selected position relative to said frame.

* * * * *